US011136895B2

(12) United States Patent
Kalitzin et al.

(10) Patent No.: US 11,136,895 B2
(45) Date of Patent: Oct. 5, 2021

(54) SPIRALING GROOVES AS A HUB TREATMENT FOR CANTILEVERED STATORS IN COMPRESSORS

(71) Applicant: United Technologies Corporation, Farmington, CT (US)

(72) Inventors: Georgi Kalitzin, West Hartford, CT (US); Gorazd Medic, West Hartford, CT (US); Om P. Sharma, South Windsor, CT (US); Junsok Yi, South Glastonbury, CT (US); Dilip Prasad, North Granby, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 54 days.

(21) Appl. No.: 16/268,683

(22) Filed: Feb. 6, 2019

(65) Prior Publication Data

US 2020/0248575 A1 Aug. 6, 2020

(51) Int. Cl.

| | |
|---|---|
| ***F01D 11/00*** | (2006.01) |
| ***F04D 29/16*** | (2006.01) |
| ***F04D 29/32*** | (2006.01) |
| ***F04D 29/68*** | (2006.01) |

(52) U.S. Cl.
CPC ..... *F01D 11/001* (2013.01); *F05D 2250/25* (2013.01); *F05D 2270/173* (2013.01)

(58) Field of Classification Search
CPC .... F04D 29/685; F04D 29/526; F04D 29/164; F04D 29/321; F04D 29/324; F04D 27/02; F01D 11/08; F01D 11/22; F01D 25/24; F01D 11/02; F01D 5/145; F01D 11/001; F05D 2250/25; F05D 2270/173; F05D 2250/61; F05D 2250/294; F05D 2250/15
See application file for complete search history.

(56) References Cited

U.S. PATENT DOCUMENTS

| | | | | |
|---|---|---|---|---|
| 7,645,121 | B2 | 1/2010 | Tudor | |
| 8,251,648 | B2 | 8/2012 | Johann | |
| 2007/0147989 | A1* | 6/2007 | Collins | F04D 29/685 415/173.1 |
| 2008/0044273 | A1 | 2/2008 | Khalid | |
| 2016/0010475 | A1 | 1/2016 | Alvanos | |
| 2018/0231023 | A1 | 8/2018 | Gentry | |

FOREIGN PATENT DOCUMENTS

| | | | |
|---|---|---|---|
| FR | 370215 | A | 2/1907 |
| FR | 2994718 | A1 | 2/2014 |

OTHER PUBLICATIONS

Extended European Search Report dated Jun. 22, 2020 for EP Application No. 20155953.1.

* cited by examiner

*Primary Examiner* — J. Todd Newton
*Assistant Examiner* — Eric J Zamora Alvarez
(74) *Attorney, Agent, or Firm* — Bachman & LaPointe, P.C.

(57) ABSTRACT

A casing treatment comprising a hub having a surface, the hub being rotatable about an axis within a casing of a gas turbine engine compressor, at least one spiral groove formed in the surface extending axially relative to the axis, a stator blade fixed to the casing, wherein a tip of the stator blade is proximate to the at least one spiral groove.

10 Claims, 4 Drawing Sheets

SPIRALING GROOVES AS A HUB TREATMENT FOR CANTILEVERED STATORS IN COMPRESSORS

BACKGROUND

The present disclosure is directed to a treatment on a rotating hub beneath compressor cantilevered stators, and more particularly the implementation of spiraling grooves formed in the rotating hub underneath the cantilevered stators.

The aerodynamic load capacity and the efficiency of fluid flow machines such as blowers, compressors, pumps and fans, is limited in particular by the growth and the separation of boundary layers in the rotor and stator blade tip area near the casing or the hub wall, respectively. On blade rows with running gaps, this leads to re-flow phenomena and the occurrence of instability of the machine at higher loads. Fluid flow machines according to the state of the art either have no particular features to provide remedy in this area, or so-called casing treatments are used as counter-measure including the most varied configurations of chambers and/or angular slots, mostly in the casing above the rotor.

Compressors in gas turbine engines must have a wide enough operability range across a range of rotating speeds in order to efficiently operate. For example, at part load conditions when the airplane is at ground or flight-idle condition, the rotational speed of the gas turbine engine compressor shaft is reduced. Under these idling conditions the variable vanes are closed, further reducing the flow through the engine. These conditions all result in rotor and stator airfoils operating at off-design conditions, precipitating increased tip clearance leakage in rotors, and cantilevered stators, as well as flow separation, in particular near end walls.

FIG. 1 shows a prior art configuration with circumferential grooves (annular recesses 4) arranged centrically and in parallel to each other on a hub 2 and having constant thickness and width. A blade 3 is arranged adjacent to the recesses 4, moving due to the rotation of the hub 2 relative to the casing 1. FIG. 2 shows a prior art configuration with a stagger angle provided for the annular recesses 4. The angle $\varepsilon$ lies in a range of +30° to −30°. The same values apply to the angle $\zeta$. Each of the prior art recesses 4 are singular and independently formed in the hub 2 and do not spiral.

What is needed is an improved form of rotor treatment that reduces the leakage and flow separation.

SUMMARY

In accordance with the present disclosure, there is provided a casing treatment comprising a hub having a surface, the hub being rotatable about an axis within a casing of a gas turbine engine compressor, at least one spiral groove formed in the surface extending axially relative to the axis, a stator blade fixed to the casing, wherein a tip of the stator blade is proximate to the at least one spiral groove.

In another and alternative embodiment, the at least one spiral groove is a helix.

In another and alternative embodiment, the at least one spiral groove comprises an angle of inclination angled relative to the axis.

In another and alternative embodiment, the angle of inclination ranges from 45 degrees to 135 degrees.

In another and alternative embodiment, the casing treatment further comprises a flow path between the hub and the casing, wherein the at least one spiral groove is configured to add energy to a working fluid in the flow path, and minimize a leakage flow that moves opposite the flow path.

In another and alternative embodiment, the at least one spiral groove comprises a taper proximate at least one of an inlet and an outlet of each of the at least one spiral groove.

In another and alternative embodiment, the casing treatment further comprises multiple spiral grooves formed on the surface of the hub, wherein at least one of the multiple spiral grooves is configured to function at a predetermined operating condition of a compressor.

In accordance with the present disclosure, there is provided a gas turbine compressor section with a casing treatment comprising a casing proximate the gas turbine compressor section; a stator blade fixed to the casing; a rotary hub proximate a tip of the stator blade, the rotary hub configured to rotate around an axis; and at least one spiral groove formed in a surface of the rotary hub proximate the tip.

In another and alternative embodiment, the stator blade is a cantilever stator blade.

In another and alternative embodiment, the at least one spiral groove comprises an angle of inclination angled relative to the axis, wherein the angle of inclination ranges from 45 degrees to 135 degrees.

In another and alternative embodiment, the at least one spiral groove comprises a taper proximate at least one of an inlet and an outlet of each of the at least one spiral groove.

In another and alternative embodiment, the gas turbine compressor section with a casing treatment further comprising multiple spiral grooves formed on the surface of the hub, each of the multiple grooves being tailored for different operating conditions of the gas turbine compressor.

In another and alternative embodiment, a depth of the at least one spiral groove comprises a value as high as 10% of a chord of the blade.

In accordance with the present disclosure, there is provided a process for reducing a tip clearance leakage flow past a cantilever stator tip and hub in a gas turbine compressor section the process comprises forming a spiral groove in a surface of the hub; rotating the hub around an axis such that the spiral groove in the hub moves relative to the cantilever stator tip; and directing the tip clearance leakage flow in a counter direction along a flow path of the compressor proximate the cantilever stator tip.

In another and alternative embodiment, rotating the spiral groove further comprises producing additional work energy added to the working fluid flowing in the flow path of the compressor proximate the cantilever stator tip.

In another and alternative embodiment, the process further comprises aligning the spiral groove at an angle of inclination angled relative to the axis, wherein the angle of inclination ranges from 45 degrees to 135 degrees.

In another and alternative embodiment, the spiral groove comprises a taper proximate at least one of an inlet and an outlet of each of the at least one spiral groove.

In another and alternative embodiment, the process further comprises forming the spiral groove along the hub at an axial location relative to the cantilever stator tip.

In another and alternative embodiment, rotating the hub around the axis, such that the spiral groove in the hub moves relative to the cantilever stator tip, creates an axial motion of the spiral groove relative to the cantilever stator tip.

In another and alternative embodiment, the process further comprises forming multiple spiral grooves along the hub tailored for different operating conditions within the compressor.

The operability of high-pressure compressors which use cantilevered stators can be improved by applying casing treatment on the rotating hub underneath them. One form of treatment includes a single or multiple spiral grooves in the rotating hub, as illustrated in FIG. 3. They passively impact flow, and improve the stable operating range for the specific stages or groups of stages (blocks) of the compressor, and ultimately the entire compressor.

Since the hub is rotating, the treatment can be designed such that it produces additional work, further energizing the flow. We propose grooves that spiral around the hub. In contrast to prior circumferential grooves of FIGS. 1 and 2, the proposed spiraling grooves create an axial motion of the groove surface when the hub rotates. This motion is in the mean flow direction and pushes the near wall flow downstream, thus delaying eventual separation to a downstream location.

Other details of the casing treatment are set forth in the following detailed description and the accompanying drawings wherein like reference numerals depict like elements.

DETAILED DESCRIPTION

Figure 1:
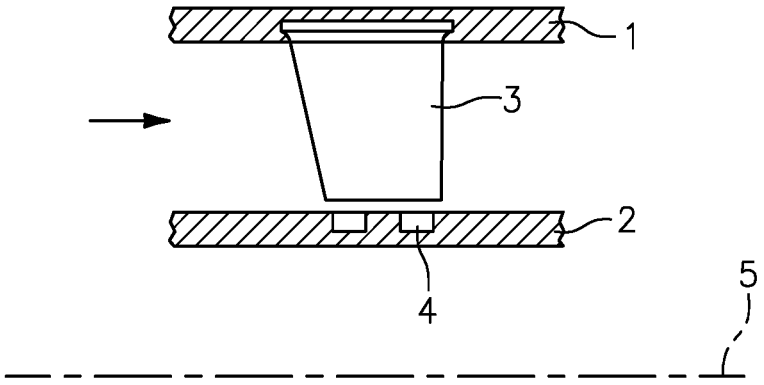
FIG. 1 (PRIOR ART)
FIG. 1 is a schematic of a prior art a blade and hub design.
Figure 2:
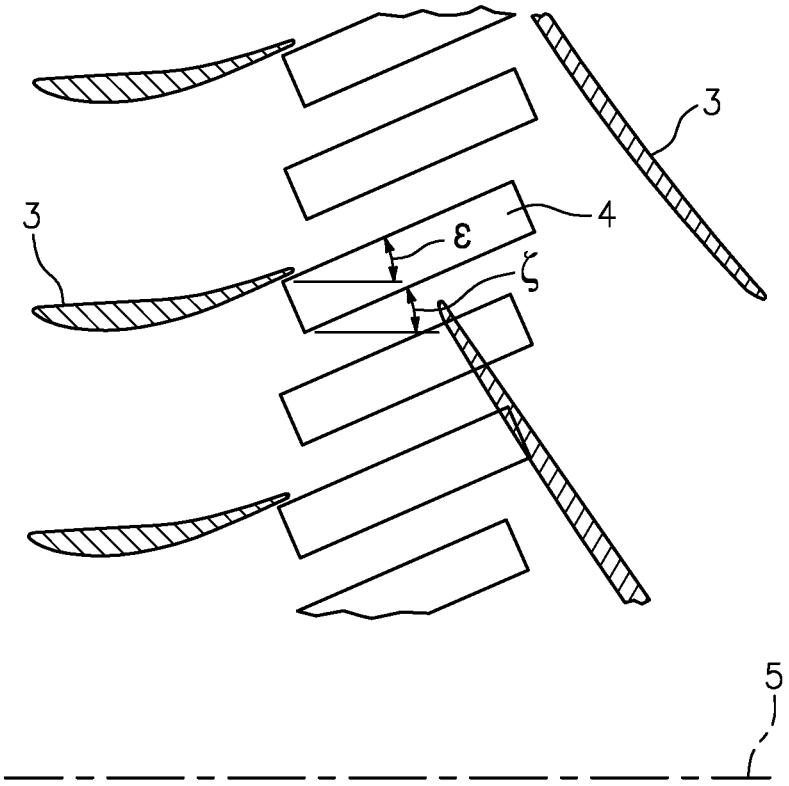
FIG. 2 (PRIOR ART)
FIG. 2 is a schematic of a prior art blade and hub design.
Figure 3:
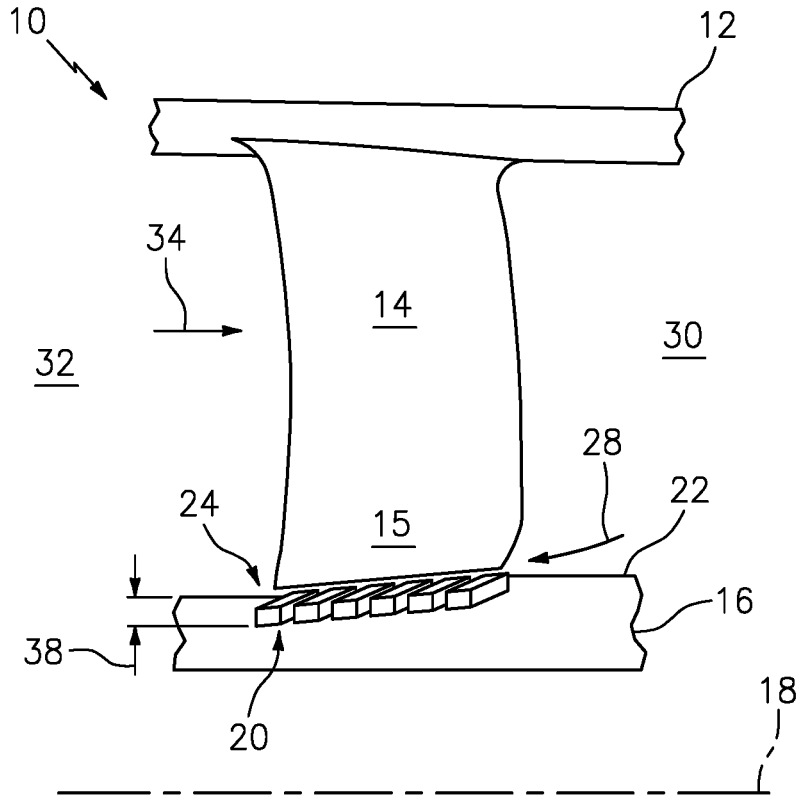
FIG. 3 is a schematic of an exemplary embodiment of the casing treatment.

Referring now to FIG. 3, an exemplary compressor section 10 of a gas turbine engine. The compressor section 10 includes a casing 12 with a stator blade 14 having a tip 15 proximate a hub 16 that rotates about an axis 18. In an exemplary embodiment, the stator blade 14 can be one of the cantilevered stators in the compressor.

Figure 4:
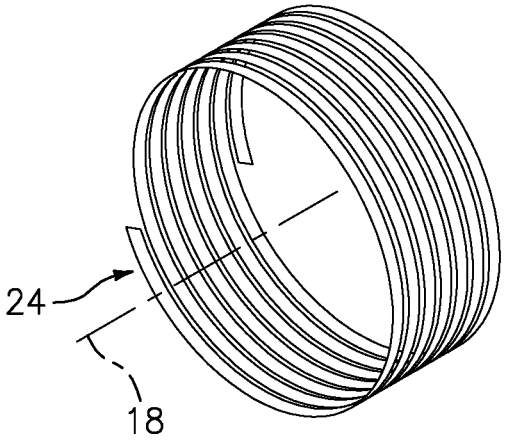
FIG. 4 is a schematic of an exemplary embodiment of the spiral shape of the casing treatment.
Figure 5:
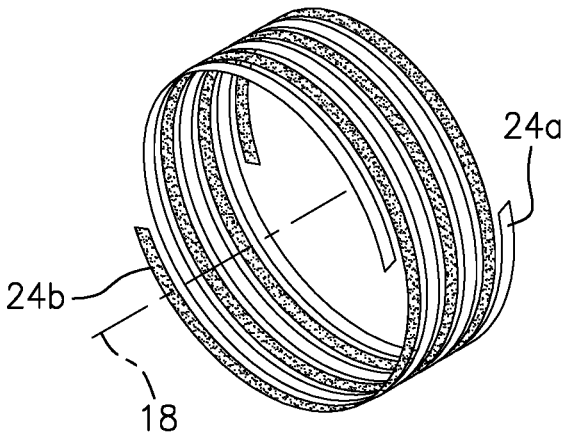
FIG. 5 is a schematic of an exemplary embodiment of double spiral casing treatments.

An exemplary treatment 20 is formed in the hub 16. The treatment 20 can be formed in an outer surface 22 of the hub 16. In an exemplary embodiment, the treatment 20 can include a spiral groove 24 formed in the surface 22, see also FIG. 4. FIG. 4 shows an exemplary spiral groove 24. In another exemplary embodiment the treatment 20 can include multiple spiral grooves 24, see also FIG. 5. FIG. 5 shows two exemplary spiral grooves 24; a first spiral groove 24*a* and a second spiral groove 24*b*. The first spiral groove 24*a* may be tailored or optimized to be more effective at different operating conditions than second spiral grooves 24*b*, and vice versa. In the exemplary embodiment, the multiple spiral grooves 24*a*, 24*b* formed on the surface 22 of the hub 16, can be tailored for different operating conditions of the gas turbine compressor 10. At least one of the multiple spiral grooves 24*a*, 24*b*, can be configured to function at a predetermined operating condition of the compressor 10. In an exemplary embodiment, the first spiral groove 24*a* can be tailored to operate at a part load condition, the second spiral groove 24*b* can be configured to operate at a full load condition, and any combinations thereof. The spiral grooves 24 disclosed herein are clearly distinguished over the prior art circumferential recess 4, since the spiral groove 24 is formed in a continuous groove spiraled along the surface 22 with an angle of inclination A, such as, a helix angled relative to the axis 18. Each of the prior art circumferential recesses 4 are independent and do not spiral or form a helix angled relative to the axis. The spiral groove 24 can have a width 26 (see FIG. 6) that can be defined so as to influence the fluid flow characteristics proximate the surface of the hub 22 beneath the cantilever blades 14 to help to prevent the tip clearance leakage flow 28 from the higher pressure region 30 back to the lower pressure region 32.

Figure 6:
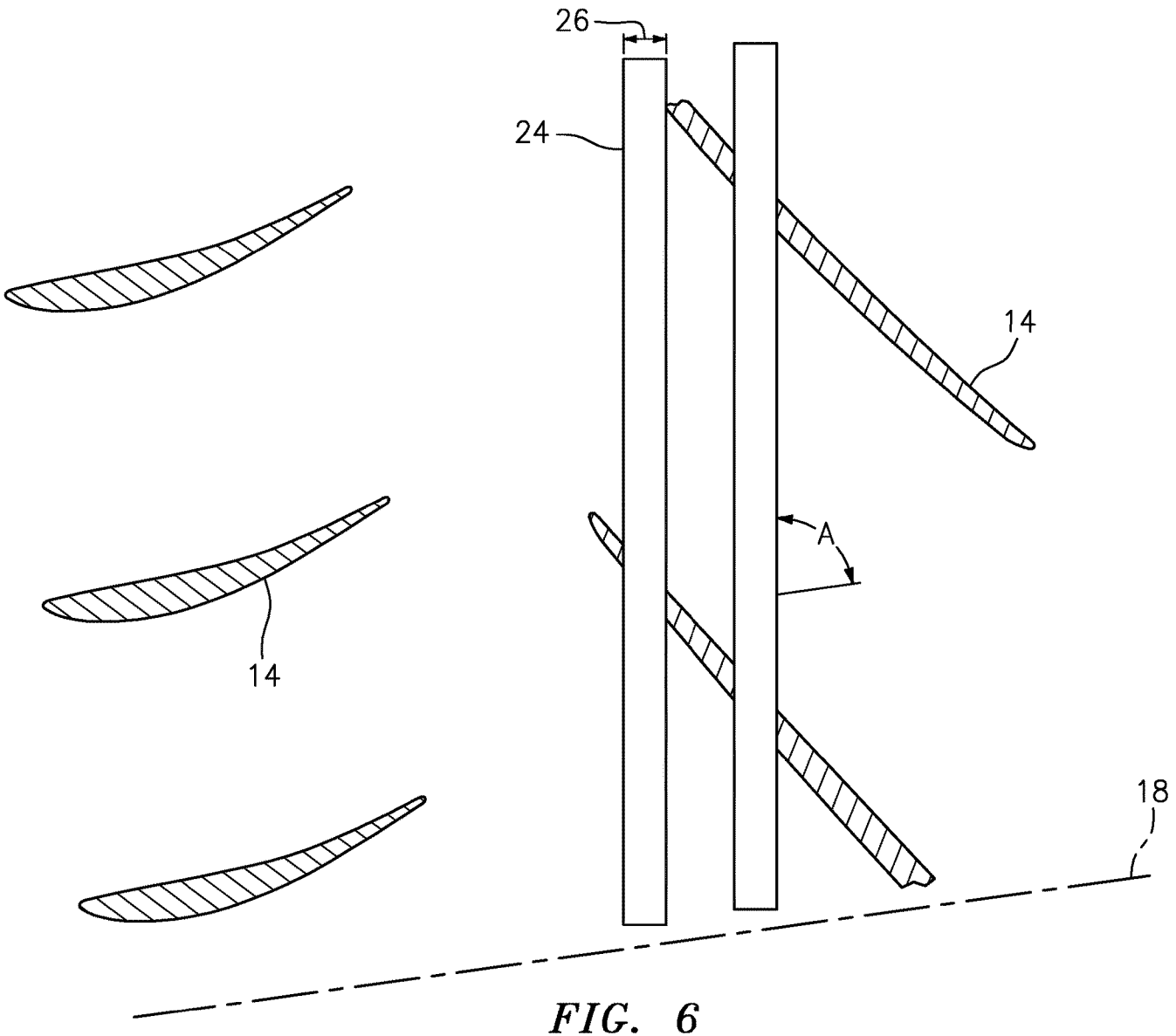
FIG. 6 is a schematic of an exemplary embodiment of the spiral casing treatment.

Referring also to FIG. 6, the exemplary embodiment of the spiral groove 24 is shown relative to the stator blades 14. The spiral groove 14 includes the angle of inclination A relative to the axis 18 that can range from 45 degrees to 135 degrees. In another exemplary embodiment angle of inclination can ranges from 70 degrees to 100 degrees. In another exemplary embodiment the angle of inclination A can be 90 degrees. The angle of inclination A, or helix angle, of the spiral groove 24 relative to the axis 18, as well as the width 26 of the spiral groove 24 are parameters of the exemplary design that influence the tip clearance leakage flow 28. In an embodiment, where the spiral groove 24 is inclined only slightly off the axial direction, they are spiraling around the hub as shown in FIG. 4 and FIG. 5. This results in the addition of a velocity component to the surface of the spiral groove 24 in the axial direction.

The exemplary design provides the advantage of when the hub is rotating: the spiral groove 24 moves underneath the stator 14 in the axial direction and creates an axial motion of the spiral groove 24 relative to the cantilever stator tip 15. As such the location relative to the stator 14 does not need to be specified. Further, the movement of the spiral grove 24 surface in axial (or flow) direction adds energy to the working fluid flow field 34, thus minimizing the leakage flow 28. The leakage flow 28 flows counter to the direction of the working fluid flow 34. The spiral groove 24 can be formed on the hub 16 at an axial location relative to the cantilever stator tip 15. The spiral groove 24 can be formed on the hub 16 between any two axial locations relative to the cantilever stator tip 15. The spiral groove 24 helps to prevent the tip clearance leakage flow 28.

The helix angle of inclination A, i.e. angle of the inclination from the circumferential direction, determines the speed at which the spiral groove surface moves in the axial direction. The circumferential direction is orthogonal to the axis 18. The larger the angle A the greater the axial surface movement of the working fluid 34. Depending on the helix angle A, the size of the spiral groove 24, and the chord of the stator 14, one or several spiral grooves 24 can be considered. In an exemplary embodiment, the spiral groove depth can be as large as 10% of the chord.

The exemplary embodiment in which there are two spiral grooves 24*a*, 24*b*, as seen in FIG. 5, there is created, upon the rotation of the spiral grooves 24*a*, 24*b*, a larger wall velocity in the axial direction, as the angle A is steeper. More spiral grooves 24 will increase uniformity of the flow field 34. However, for a shallow angle A, the rotation of spiral grooves 24 mainly creates an axial wall velocity component, while for larger angles A the circumferential component becomes more dominant. In an exemplary embodiment, the optimal angle A can be determined by an inlet profile for a given stator 14 in the compressor 10.

Figure 7:
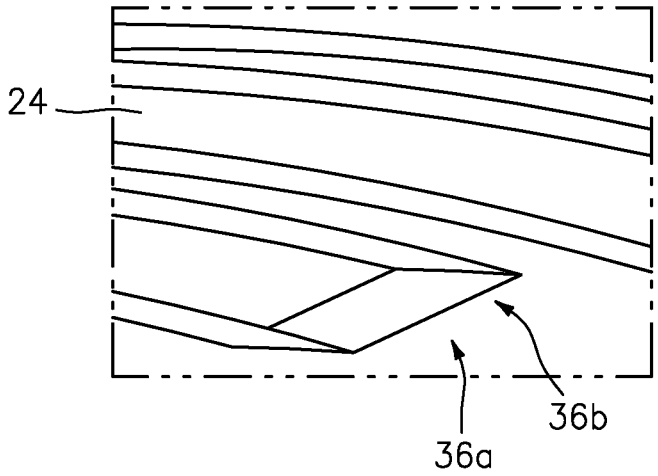
FIG. 7 is a schematic of an exemplary embodiment of an inlet or outlet of a spiral casing treatment.

Referring to FIG. 7, an inlet 36*a* and/or an outlet 36*b* to the spiral grooves 24 can be made to taper, so that the inlet/outlet are at least one of smooth and/or more shallow than the spiral groove 24. The inlet 36*a* and/or outlet 36*b* can have an inclined or pitched profile in order to provide fluid flow characteristics. In an exemplary embodiment, a spiraling groove with a small helix angle A, can include a lower profile at the inlet 36*a*/outlet 36*b*, as seen at FIG. 7. For a larger helix angle A, when the spiral groove 24 becomes a shorter, inclined slot, the entire groove can have variable groove depth 38.

In alternative exemplary embodiments, utilization of spiral grooves 24 can also be beneficial on the hub of other rotating portions of the gas turbine engine, like parts with compressor blades, with a design that can cross the passage from blade to blade. In another alternative embodiment, the treatment 20 could be formed in a wall of the casing 12 proximate sections of rotary blades (not shown).

There has been provided a rotor treatment. While the rotor treatment has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A casing treatment comprising:

a hub having a surface, said hub being rotatable about an axis within a casing of a gas turbine engine compressor, at least one spiral groove formed in said surface extending axially relative to said axis, wherein said at least one spiral groove comprises an angle of inclination angled relative to the axis, said angle of inclination ranges from 70 degrees to 100 degrees;

a stator blade fixed to said casing, wherein a tip of said stator blade is proximate to said at least one spiral groove.

2. The casing treatment according to claim 1, wherein said at least one spiral groove is a helix.

3. The casing treatment according to claim 1, further comprising:

a flow path between said hub and said casing, wherein said at least one spiral groove is configured to add energy to a working fluid in said flow path, and minimize a leakage flow that moves opposite said flow path.

4. The casing treatment according to claim 1, wherein said at least one spiral groove comprises a taper proximate at least one of an inlet and an outlet of each of said at least one spiral groove.

5. The casing treatment according to claim 1, further comprising:

multiple spiral grooves formed on said surface of said hub, wherein at least one of said multiple spiral grooves is configured to function at a predetermined operating condition of a compressor.

6. A gas turbine compressor section with a casing treatment comprising:

a casing proximate said gas turbine compressor section;

a stator blade fixed to said casing;

a rotary hub proximate a tip of said stator blade, said rotary hub configured to rotate around an axis; and at least one spiral groove formed in a surface of said rotary hub proximate said tip, wherein said at least one spiral groove comprises an angle of inclination angled relative to the axis, wherein said angle of inclination ranges from 45 degrees to 135 degrees.

7. The gas turbine compressor section with a casing treatment according to claim 6, wherein said stator blade is a cantilever stator blade.

8. The gas turbine compressor section with a casing treatment according to claim 6, wherein said at least one spiral groove comprises a taper proximate at least one of an inlet and an outlet of each of said at least one spiral groove.

9. The gas turbine compressor section with a casing treatment according to claim 6, further comprising multiple spiral grooves formed on said surface of said hub, each of said multiple grooves being tailored for different operating conditions of said gas turbine compressor.

10. The gas turbine compressor section with a casing treatment according to claim 6, wherein a depth of said at least one spiral groove comprises a value as high as 10% of a chord of said blade.

* * * * *